US007097436B2

(12) United States Patent
Wells

(10) Patent No.: US 7,097,436 B2
(45) Date of Patent: Aug. 29, 2006

(54) APEX SPLIT SEAL

(76) Inventor: David S. Wells, 879 Elm St., Sugar Grove, IL (US) 60554

( * ) Notice: Subject to any disclaimer, the term of this patent is extended or adjusted under 35 U.S.C. 154(b) by 234 days.

(21) Appl. No.: 10/882,693

(22) Filed: Jun. 29, 2004

(65) Prior Publication Data

US 2005/0180874 A1 Aug. 18, 2005

Related U.S. Application Data

(60) Provisional application No. 60/544,683, filed on Feb. 17, 2004.

(51) Int. Cl.
*F01C 19/02* (2006.01)

(52) U.S. Cl. ..... 418/113; 418/117; 418/122

(58) Field of Classification Search ..... 418/61.2, 418/113, 114, 116, 117, 122
See application file for complete search history.

(56) References Cited

U.S. PATENT DOCUMENTS 3,215,340 A * 11/1965 Lamm ..... 418/61.2
3,261,334 A * 7/1966 Paschke ..... 418/92
3,781,148 A * 12/1973 Sakamaki ..... 418/117
3,794,450 A * 2/1974 Klomp ..... 418/117
3,830,600 A * 8/1974 Shimoji et al. ..... 418/113
3,884,600 A * 5/1975 Gray ..... 418/61.2
3,920,359 A * 11/1975 Gray ..... 418/87
4,389,172 A * 6/1983 Griffith ..... 418/61.2
4,548,560 A * 10/1985 Kanao ..... 418/144

* cited by examiner

*Primary Examiner*—Hoang Nguyen
(74) *Attorney, Agent, or Firm*—Wood, Phillips, Katz, Clark & Mortimer

(57) ABSTRACT

A rotary machine including a rotor having apexes provided with apex seals achieves better efficiency through the use of apex split seals which minimize leakage across the apex seals to thereby allow operation at relatively high pressure values.

16 Claims, 3 Drawing Sheets

APEX SPLIT SEAL

CROSS REFERENCE

This application claims the benefit of U.S. provisional patent application, application No. 60/544,683 filed Feb. 17, 2004 by the applicant hereof.

FIELD OF THE INVENTION

This invention relates to rotary machines of the trochoidal type, and more particularly, to apex seals for the rotors of such machines.

BACKGROUND OF THE INVENTION

Trochoidal machines (the term "trochoidal" as used herein is also intended to encompass epitrochoidal machines as well as true trochoidal ones) have long been known. Perhaps the most well known example is the Wankel engine. Such machines have, however, been used for other purposes, including, for example, the compression of gas. As is well known, such rotary machines include a rotor that is nominally triangular in shape and which generally has the appearance of an equilateral triangle whose three sides are convex. The rotor is mounted on an eccentric on the machine shaft and typically is tied to a housing by means of a spur gear configuration on one side of the rotor meshed with a ring gear formation on the corresponding side of the machine housing.

The rotor is contained in a chamber that is trochoidal in shape. Seals are carried at each apex of the rotor to sealingly engage the chamber periphery. Side seals are also carried by the rotor near its periphery for sealingly engaging the sides of the chamber and typically, so-called corner seals are located at the interface of the ends of the apex seals and the ends of the side seals on both sides of the rotor. Intake and exhaust porting is provided in the chamber periphery with one port being located on one side of the so-called "waist" of the chamber and the exhaust port on the other.

Oppositely of the porting, other components may be located, depending upon the use to which the machine is being put. In the case of an engine, ignition devices are located of one or both sides of the waist oppositely of the ports. Alternatively, fuel injection devices may be located in generally the same place as the ignition devices if the engine is to operate on the diesel cycle.

While engines of this sort have been commercially produced, particularly for powering vehicles, they have not achieved the acceptance of conventional reciprocating engines for a variety of reasons.

Specifically, a known type of a rotary engine that has been commercially sold as a power plant for a vehicle has a theoretical compression ratio of 10:1 but only produces a maximum internal pressure in the range of 85 to 100 psi. during the compression part of the rotary cycle at cranking speed. On the other hand, a reciprocating engine having the same compression ratio would, at cranking speed, produce an internal pressure in the range of 170 to 200 psi., and if the seals of either engine were perfect, the internal pressure would be significantly higher. The difference between the theoretical and actual pressures is the result of seal leakage. Seal leakage is more critical in a rotary engine than in a reciprocating engine because at 6000 rpm, a reciprocating engine's compression phase takes approximately 0.005 seconds, whereas that of the rotary engine takes approximately 0.0075 seconds. The seals of the rotary engine are therefore subject to leakage for a 50% longer period of time than those of reciprocating engines at the same rpm.

Because rotary engines can and do operate at significantly higher rpms, the problem is somewhat lessened. However, due to the lesser compression attainable in rotary engines, the same are currently inferior to reciprocating engines in terms of power produced per unit of fuel, which translates into a reduction in gas milage, and increased hydrocarbon admissions. Thus, rotary engine performance is far inferior to its potential.

Apex seals are perhaps the greatest cause of lack of compression due to leakage in a rotary engine of the type having a rotor provided with apexes. Specifically, internal combustion engines of all types typically rely on so-called "gas energization" of seals to produce the desired sealing effect during compression and combustion phases of their cycle of operation. Seals that are gas-energized are typically found somewhat loosely in grooves in which they may move slightly from side to side and in and out of the groove. Conventionally, a light biasing spring will be placed between the bottom of the groove and the innermost end of the seal to bias the opposite end of the seal into light sealing contact with the operating chamber wall. When subject to pressure, as during compression or combustion phases of the operating cycle, the pressure acts against the high pressure side of the seal to force the opposite side to seal tightly against the side of the groove. The gas under pressure also enters the groove to act against the radially inner end of the seal and bias the same outwardly into good sealing engagement with the wall of the operating chamber. This is true whether the seal is a piston ring, an apex seal, or a side seal. There is, however, a major difference in the operation of apex seals. During the compression phase of an engine, the apex seal must seal against the trailing wall of the seal receiving groove to achieve compression. When the compression phase is completed, and the combustion phase is entered, the higher pressure now exists on the opposite side of the apex seal, requiring it to shift within its groove so that its leading side seals against the leading side of the seal receiving groove. This shifting of the apex seal leads to the momentary creation of a leakage path around the seal between the sides of the groove as the seal transitions from sealing engagement against one groove wall to sealing engagement against the other groove wall. Moreover, when the pressure acting against the leading face and inward end of the seal, acts against the outermost end of the seal and the trailing face may reach a value so that there is a net positive pressure acting on the seal in the radially inward direction. It can be sufficient to exceed the combined force of the biasing spring and centrifugal force generated by the mass of the apex seal. Consequently, a small gap may occur at the interface of the outermost tip of the seal and the wall of the operating chamber, allowing leakage through this gap as well. All of this creates a loss of efficiency.

A second point of failure of apex seals can occur when the pressure from combustion increases very rapidly. In order to maintain a tight seal between the outer sealing edge of the apex seal and the operating chamber wall, the pressure at the inner part of the apex seal must also increase substantially equally as rapidly. However, since the gas to create the pressure must travel through a narrow gap between the apex seal and the side of the groove in which the seal resides, the outward biasing pressure cannot increase as rapidly and an inwardly movement of the seal results in a loss of sealing contact, especially at high rpm.

A third cause of leakage can occur as an apex seal passes 300° past bottom dead center (bdc) to the time it reaches the exhaust port, typically located at about 60° past bdc. During this time, pressure in the trailing chamber is required to hold the apex seal tight against the leading face of the groove in which it resides. However, frictional forces at the tip of the apex seal act counter to the pressure forces and at some point in time between 300° and 60° past bdc, a gap will occur on both sides of the apex seal resulting in undesirable leakage around the apex seal.

Still another cause of loss of pressure occurs as the apex seal passes recesses in the operating chamber wall employed in ignition and/or fuel injection systems.

A further cause may result from seal warpage. Extreme heat encountered in the operating cycle of the engine may cause a conventional apex seal to warp out to in or from side to side resulting in the creation of more leakage paths at the tip of the seal.

Still another cause of leakage may result if the seal resonates at its natural frequency along its length. Because the slot in which the seals are received are larger than the seal, i.e., the slot width is greater than the width of the seal, the seal may resonate, creating gaps which allow leakage.

The present invention is directed to overcoming one or more of the above problems.

SUMMARY OF THE INVENTION

It is the principal object of the invention to provide a new and improved rotary machine. More specifically, it is an object of the invention to provide a new and improved apex seal construction for use in rotary machines, which considerably reduces the leakage associated with conventional apex seal operation in rotary machines.

An exemplary embodiment achieves the foregoing objects in a rotary machine that includes a housing defining an operating chamber having a wall with a shaft journalled in the housing and having an eccentric within the chamber. A rotor is located within the chamber and is journalled on the eccentric and has a plurality of equally angularly spaced apexes and is timed to the housing to rotate and translate within the chamber so that all of the apexes are in close proximity to the wall for all positions of the rotor within the chamber. Intake and exhaust ports to the interior of the chamber are provided and apex seal receiving groove means are provided at each of the apexes and opened towards the wall. Two apex seals are located at each of the apexes and mounted for sliding movement in the groove means thereat while essentially preventing leakage through the groove means. Each such apex seal includes an inner mounting section received in the groove means at the apex at which the seal is located and an outwardly directed toe located outwardly of the groove means. The toes of the two apex seals at each groove means are directed oppositely away from one another and sealingly engage the wall at spaced locations.

In a preferred embodiment, the chamber wall is a peripheral wall and the groove means open radially outwardly with the apex seals at each of the apexes mounted for radial sliding movement in the associated groove means.

In one embodiment, each of the groove means consists of a single groove and both of the apex seals at each apex are received in the single groove at the apex at which they are located.

In a preferred embodiment, each of the groove means, at a radially inner location, is vented.

In one embodiment, there is further provided a vent passage between the two seals at each apex.

A preferred embodiment contemplates the use of biasing means in each of the single grooves for substantially independently biasing each of the two seals at the apex in an outwardly direction.

In a highly preferred embodiment, the biasing means includes an elongated leaf spring having a concave side opening outwardly within the groove and two opposed ends, with each spring end being bifurcated to prove two spring fingers thereat, one for each of the seals in the single groove.

In a highly preferred embodiment, the rotary machine is a rotary engine and even more preferably, the rotary engine is a trochoidal or epitrochoidal engine.

A preferred embodiment contemplates that the apex seals be bar-like and have outer, rounded sealing surfaces to make sealing contact with the wall generally along a line such that for all angular positions of the rotor within the chamber, the area on the radially outer sealing surface from the line of contact to the toe rounded end is less than the area of a pressure-responsive surface on an inner part of the toe.

Other objects and advantages will become apparent from the following specification taken in connection with the accompanying drawings.

DESCRIPTION OF THE PREFERRED EMBODIMENTS

An exemplary embodiment of the invention hereof will be described in the context of a trochoidal or so-called Wankel engine. However, it is to be understood that the seal construction of the present invention may be utilized in rotary machines other than engines as, for example, a compressor or expander, or a compressor/expander. It will also be appreciated by those skilled in the art that the invention is not limited to trochoidal machines (here, trochoidal is being used in the strict sense), but epitrochoidal machines and slant axis rotary machines as well. Consequently, no limitation to a particular type of rotary machine or to a particular use, such as use as an engine, is intended except insofar as expressly stated in the appended claims.

With the foregoing in mind, the invention will now be described.

Figure 1A:
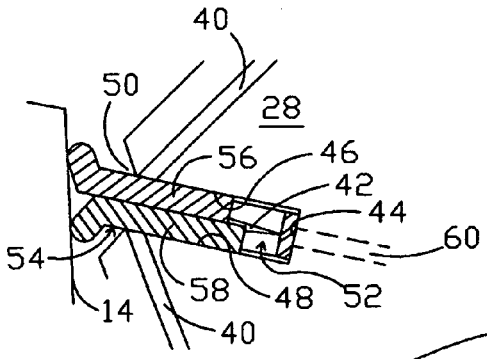
FIG. 1*a* is an enlarged view of one apex in FIG. 1.
Figure 1B:
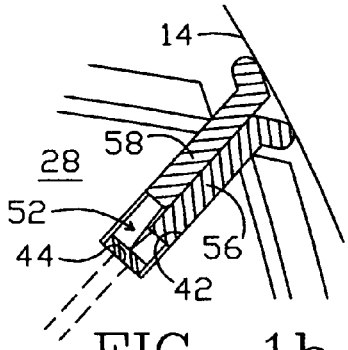
FIG. 1*b* is an enlarged view of another apex in FIG. 1.
Figure 1:
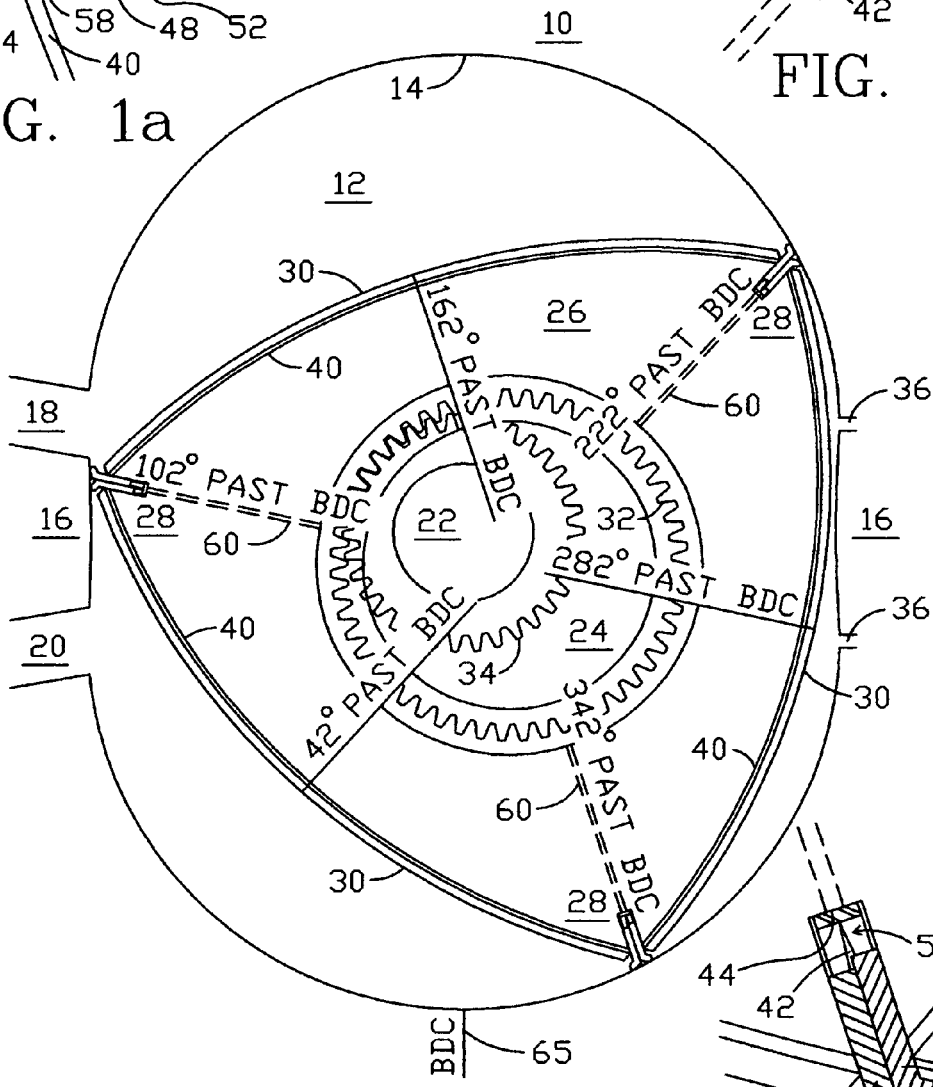
FIG. 1 is a sectional view of a rotary machine, specifically, a trochoidal engine, having a nominally triangular rotor with apex seals at each apex.

Referring to FIG. 1, a rotary machine in the form of a trochoidal or Wankel engine is illustrated and is seen to include a housing 10 defining a trochoidal operating chamber 12 having a peripheral wall 14. As is well known, the peripheral wall 14 includes a waist area 16 where the wall narrows slightly. At one point on the periphery of the wall 14, an inlet port 18 is located while on the opposite side of the waist 16 in that same area of the port 18, an outlet port 20 is provided.

A shaft 22 is journalled in the housing 10 and within the chamber 12 mounts an eccentric 24 on which a rotor 26 is journalled. The rotor 26 may be described as being nominally triangular and is formed as an equilateral triangle having three equally angularly spaced apexes 28 and bulging or convex sides 30 extending between adjacent apexes.

The rotor 26 includes, on one side thereof, an internal ring gear 32 which revolves with the rotor 26 about the eccentric 24. A fixed gear 34 which is stationary and mounted to the housing 10 is meshed with the ring gear 32, the gear 34 being generally in the form of a spur gear.

Oppositely of the ports 18 and 20, the peripheral wall 14 includes two openings 36 on opposite sides of the waist 16 in that area. The openings 36 establish fluid communication between the interior of the chamber 12 and ignition devices or fuel injection devices, or both.

Each side of the rotor 26 includes conventional side seals 40 extending between the apexes 28.

As seen in various figures, at each of the apexes 28, a radially inwardly directed groove 42 is located. The groove 42 includes a bottom wall 44, a leading sidewall 46, and a trailing sidewall 48. A radially outwardly facing open end 50 is provided for each groove 42.

Within each groove 42 is a biasing structure, generally designated 52, to be described in greater detail hereinafter, and an apex seal construction, generally designated 54, which includes a leading edge seal 56 and a trailing edge seal 58.

A preferred embodiment also includes a vent passage 60 in fluid communication with the bottom wall 44 of each groove 42 which extends to the eccentric 24 on the shaft 22 so that the radially inner end of each groove 42 is essentially vented to atmosphere for purposes to be seen.

Figure 4:
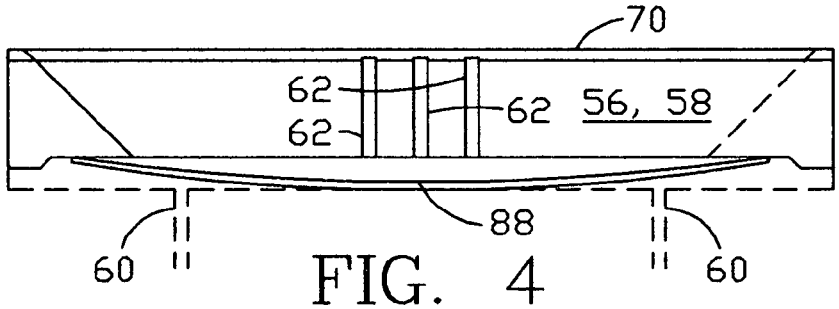
FIG. 4 is a view similar to FIG. 2, but of a modified embodiment of the apex seal.
Figure 6:
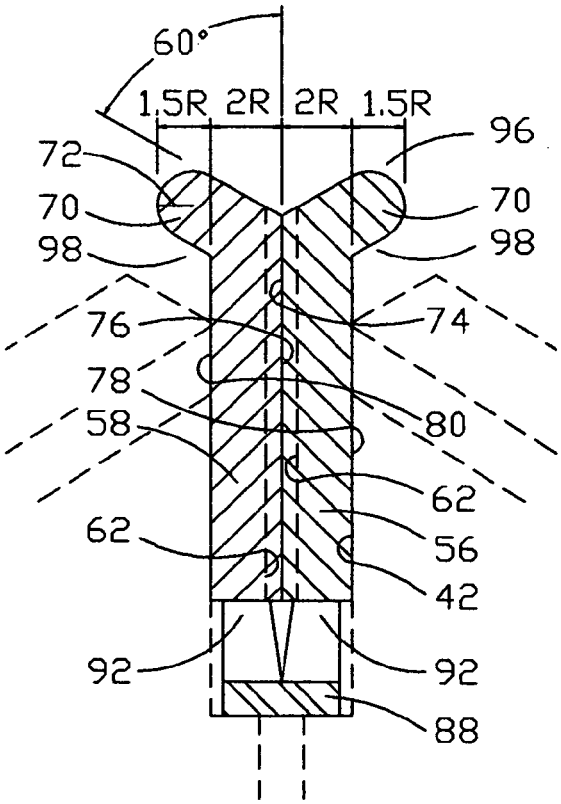
FIG. 6 is an enlarged, fragmentary view of the mounting of an apex seal within an apex groove.
Figure 7:
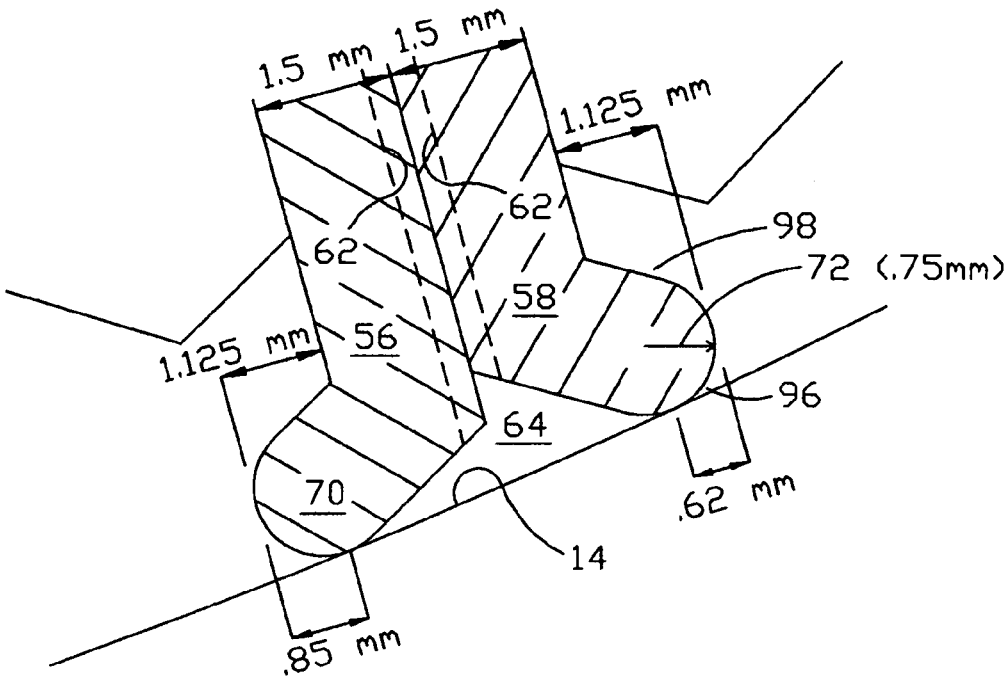
FIG. 7 is a view similar to FIG. 1*c*, but enlarged and showing certain dimensions of seal components believed to be optimal.

In some instances, grooves 62 may be cut in abutting sides of the leading seal 56 and a trailing seal 58 as shown in FIGS. 4 and 6. As seen in FIG. 7, for example, the grooves 62 together with the vent passages 60 provide a means of venting a space 64 defined by the peripheral wall 14 and radially outer parts of the leading seal 56 and the trailing seal 58, again, for purposes to be seen.

Figure 1C:
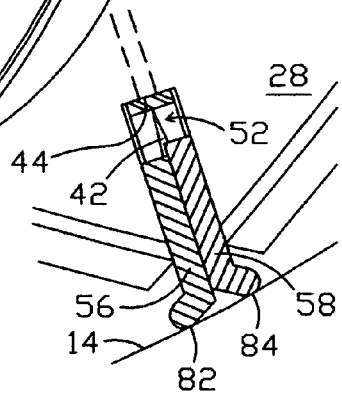
FIG. 1*c* is an enlarged view of still another apex in FIG. 1.

FIGS. 1*b* and 1*c* contain essentially the same illustration as FIG. 1*a*, except that the position of the leading and trailing seals 56 and 58 has shifted. In FIG. 1*a*, the leading edge seal 56 is extended a greater distance out of the groove 42 than has the trailing edge seal 58. This configuration is assumed by the seals at approximately 102 degrees past bdc, bdc being shown at a point 65 in FIG. 1.

In contrast, in FIG. 1*b*, the situation has reversed with the trailing edge seal 58 extending further out of the groove 42 than the leading edge 56 as would occur at about 222 degrees past bdc. FIG. 1*c* shows again a reversal of the condition where the leading edge seal 56 is again further out of the groove 42 than the trailing edge seal 58. This would be the configuration at approximately 342 degrees past bdc.

Referring now to FIG. 6, it can be seen that the cross section leading edge seal 56 is a mirror image of the trailing edge seal 58 and J or L shaped. Each seal terminates in a radially outwardly and circumferentially directed toe 70. Each toe, in turn, is rounded about a radius "R" 72. In a preferred embodiment, the toes 70 are angled at 60 degrees to the centerline of a groove 42 or to the abutting, flat side surfaces 74 and 76 of the seals 56 and 58. The seals 56 and 58 are generally in the form of elongated bars and, consequently, the seal 56 has a flat surface 78 opposite its flat surface 74 and parallel thereto while the seal 58 has an opposite flat surface 80 opposite the flat surface 76 and parallel thereto.

In an exemplary seal construction, the spacing between the surfaces 74 and 78 of the leading edge seal 56 and between the surfaces 76 and 80 of the trailing seal 58 is twice the radius "R" 72. It will also be observed that taken in a direction 90 degrees to the abutting surfaces 74 and 76 of the seals 56 and 58, the circumferential extent of each of the toes 70 is 1.5 "R."

For example, as shown in FIG. 7, the thickness of each seal 56 and 58 may be 1.5 mm, while the circumferential dimension of each toe 70, 72 and the radius of each toe 70, 72 may 0.750 mm.

Other relative dimensions may be employed so long as certain criteria set forth hereinbelow are followed.

In all events, it is important that the width of each groove 42 be substantially the size as twice the thickness of one of the seals 56, 58. Needless to say, the groove base 42 will be somewhat wider than that thickness so as to enable the seals 56, 58 to slidably move between the positions illustrated in FIGS. 1*a*, 1*b*, and 1*c* during rotation of the rotor 26. However, no significant gap, as is customary in current gas-energized seals, should be present. In short, the width dimension of the groove should be such that the seals 56, 58 slide within the grooves 42 without side to side shifting substantially fill any leakage paths through the groove as can be found in customary and conventional apex seals. That is to say, the tightest fit that will allow sliding movement of the seals 56, 58 under operating conditions should be used.

Figure 2:
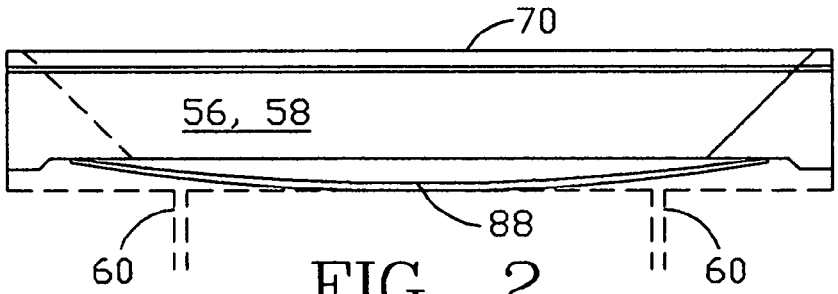
FIG. 2 is a side elevation of an apex seal employed in the invention.
Figure 3:
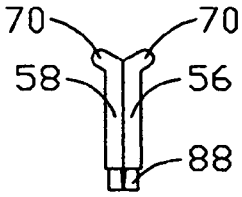
FIG. 3 is an end view of the apex seal.

The rounded toes 70 of the seals provide that the toes make contact with the peripheral wall 14 of the operating chamber in essentially a line contact as shown at 82 and 84 in FIG. 1*c*. Biasing means are provided, as mentioned previously, to bias seals 56, 58 against the peripheral wall 14 and as seen in FIGS. 2, 3, and 4, include an elongated, curved leaf spring 88, whether or not the seal 56, 58 is provided with the vent groove 62.

Figure 5:
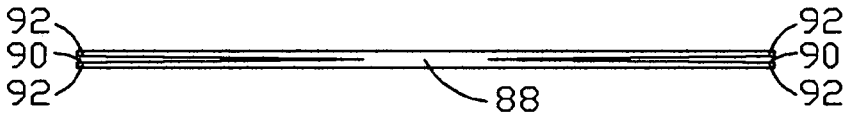
FIG. 5 is a plan view of a biasing spring used with the seal.

As seen in FIG. 5, each leaf spring 88 includes bifurcated ends 90. The bifurcated ends 90 define two spring fingers 92 at each end of the leaf spring 88, one for each end of the seals 56 and 58. As seen in FIG. 6, one pair of the spring fingers 92 provide an outward bias for the seal 56, while the other spring fingers 92 provide an outward bias for the seal 58. Because the bifurcation extends very nearly to the center of the leaf spring 88, it will be appreciated that essentially an independent bias is provided to each of the seals 56 and 58 by a unitary structure, thereby minimizing assembly costs.

Returning now to FIG. 6, it can be seen that each toe has a radially outer sealing surface 96 and an opposite pressure-responsive surface 98 that is located outside of the radially outer end of the groove 42. The foregoing dimensions or relative dimensions of the constructions of the seals given in connection with the description of FIGS. 6 and 7 are chosen such that the area of the pressure-responsive surface 98 will always be greater than the area of the sealing surface 96 exposed to high pressure during an operational cycle. That area, of course, will be the effective area between the line contact shown at 82 in FIG. 1*c* and FIG. 8 and the point on the toe 70 most remote from a plane defined by, for example, one of the side surfaces 74, 76, 78, 80. The effective area subject to pressure tending to drive the seal 56 or 58 into the groove 42 will then always be less than the pressure acting on the pressure-responsive surface 98 which is exposed to the same pressure in any event. Consequently, good sealing contact will be made with the peripheral wall 14 through gas energization without the need for the gas to enter the groove 42 and create a leakage path.

Figure 8:
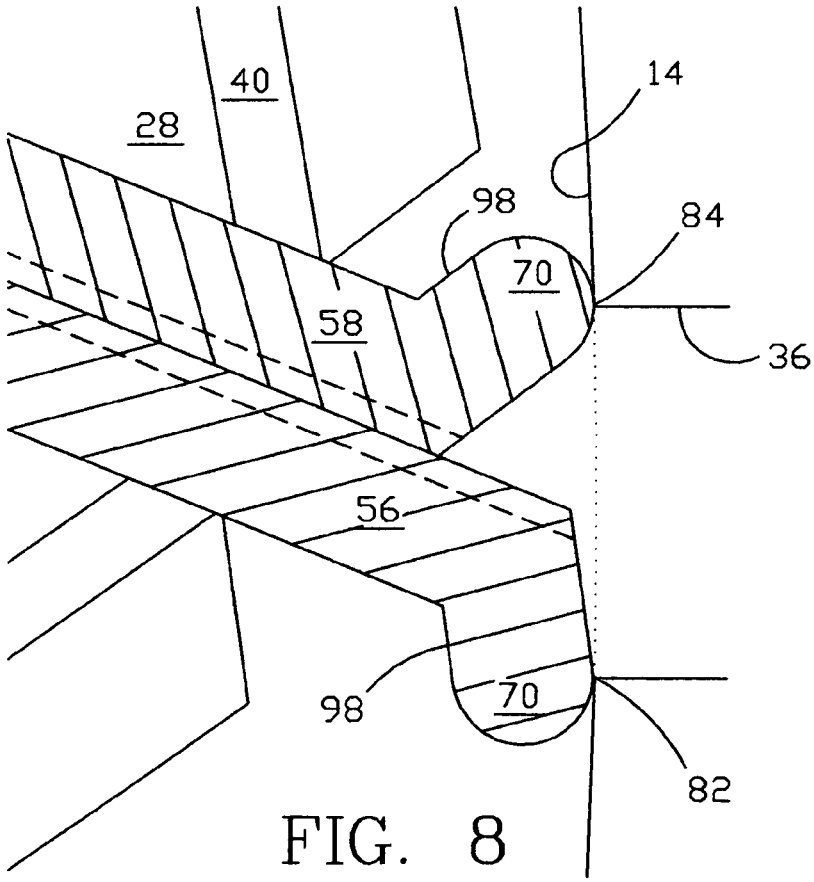
FIG. 8 is a view of an exemplary embodiment of an apex seal made according to the invention passing over an opening or recess in the operating chamber wall.

Additionally, the spark plug or fuel injection ports 36 may be dimensioned so as to be bridged by the two seals as shown in FIG. 8 to minimize pressure loss on the high pressure side of one seal assembly 54 to the low pressure side thereof upon the seal assembly crossing such a port 36.

It can be shown that the total force acting outwardly on the leading and trailing seals 56 and 58 is reduced from that found in conventional apex seals because high pressure is acting only on the leading seal 56 or the trailing seal 58 if it is acting at all, and the spring force may be minimal as well. Thus, seal wear is reduced.

From the foregoing description, it will be appreciated that various forms of leakage through grooves corresponding to the grooves 42 herein, but in conventional rotary machines, is considerably reduced using the invention, thus allowing higher pressures to be obtained within the machine. Furthermore, because the apex seals of the present invention do not shift from side to side within the grooves 42, it is possible to extend the side seals 40 completely to the apex seals, and thus eliminate the corner seals used in conventional engines while retaining their function. Consequently, use of an apex seal assembly made according to the invention achieves all the benefits of gas energization of seals while eliminating various leakage paths about the seal and reducing the frictional force with which the seals engage the operating chamber wall 14 to thereby minimize wear.

What is claimed is:

1. In a rotary machine having a housing defining an operating chamber having a trochoidal or epitrochoidal wall, a shaft journalled within said housing and extending through said chamber, an eccentric on said shaft within said chamber, a nominally triangular rotor in said chamber and journalled on said eccentric, timing gearing on said housing and said rotor, apex seal receiving grooves at apexes on said rotor, and apex seals within said grooves and engaging said wall, the improvement wherein the apex seal at each apex includes a pair of elongated, bar-like seals of J or L shaped cross section with vertical parts in back-to-back relation and slidable on one another, and further slidably disposed within the corresponding groove for radial movement relative to one another and within the groove, said vertical parts being sized to fit within said groove sufficiently snugly to prevent side to side shifting of said vertical parts within said groove sufficient to prevent a leakage path within said groove around said vertical parts of said seal to come into existence, said bar-like seals terminating in radially outer sealing surfaces engaging said wall and pressure-responsive surfaces opposite the sealing surfaces and located out of said groove, biasing means in said groove for providing a radially outward bias to each of said bar-like seals generally independently of each other; and a vent port at the bottom of said groove.

2. The rotary machine of claim 1 wherein said machine is an engine and further including an intake port in said wall, an exhaust port in said wall adjacent said intake port, and at least one ignition device associated with said wall oppositely of said ports.

3. The rotary machine of claim 2 wherein said biasing means comprises an elongated leaf spring having opposite ends, each spring end being split into two fingers for engaging only a corresponding one of said bar-like seals within said groove and opposite from said sealing surface thereof.

4. The rotary machine of claim 2 wherein the interface of said bar-like seals where they are in back-to-back relation is provided with a vent in fluid communication with said groove vent and with a space between the sealing surface of the two bar-like seals in each groove.

5. In a rotary machine having a housing defining an operating chamber having a trochoidal or epitrochoidal wall, a shaft journalled within said housing and extending through said chamber, an eccentric on said shaft within said chamber, a nominally triangular rotor in said chamber and journalled on said eccentric, timing gearing on said housing and said rotor, apex seal receiving grooves at apexes on said rotor, and apex seals within said grooves and engaging said wall, the improvement wherein the apex seal at each apex includes a pair of bar-like seals, each pair each bar-like seal including a radially inner, radially directed mounting section terminating at a radially outer end in a radially outward and circumferentially directed toe having a rounded end remote from said mounting section, said toe having a radially outer sealing surface sealingly engaging said wall and an opposite radially inner pressure-responsive surface located radially outward of said apex seal receiving grooves, the mounting sections of the bar-like seals of each pair being received in a corresponding groove such that the toes of the bar-like seals in each pair are directed away from one another to define a space therebetween, each pair of said bar-like seals being received in a corresponding one of said grooves for radial sliding within the groove and with respect to each other with said mounting sections sealing against an adjacent wall of the groove in which they are received.

6. The rotary machine of claim 5 wherein said radially outer rounded sealing surfaces make generally sealing contact with said wall along a line such that for all angular positions of said rotor within said chamber the effective area on said radially outer sealing surface from said line to said toe rounded end is less than the area of said pressure-responsive surface.

7. The rotary machine of claim 6 wherein each of said grooves has a radially inner end, and a vent port at each said groove inner end.

8. The rotary machine of claim 7 further including a vent at the interface of said mounting sections extending from said space to be in fluid communication with said vent port.

9. In a rotary engine, the combination of:

a housing defining an operating chamber having a wall;

a shaft journalled in said housing and having an eccentric within said chamber;

a rotor within said chamber journalled on said eccentric and having a plurality of equally angularly spaced apexes and timed to said housing to rotate and translate within said chamber so that all said apexes are in close proximity to said wall for all positions of said rotor within said chamber;

intake and exhaust ports within said wall;

apex seal receiving groove means at each of said apexes and opening toward said wall; and two apex seals at each of said apexes mounted for sliding movement in the groove means thereat while essentially preventing leakage through said groove means, each said apex seal including inner mounting sections received in the groove means at the apex at which the seal is located, and an outwardly directed toe located outwardly of the groove means, the toes of the two apex seals at each said groove means being directed oppositely away from one another and sealingly engaging said wall at spaced locations.

10. The rotary machine of claim 9 wherein each said groove means consists of a single groove and both of the apex seals at each apex are received in said single groove at the apex at which they are located.

11. The rotary machine of claim 10 further wherein each said single groove, at a radially inner location, is vented.

12. The rotary machine of claim 11 further including a vent passage between the two seals at each apex.

13. The rotary machine of claim 9 wherein each said groove means, at a radially inner location, is vented.

14. The rotary machine of claim 10 further including biasing means in each said single groove for substantially independently biasing of said two seals at the apex in a radially outward direction.

15. The rotary machine of claim 14 wherein said biasing means for each said single groove includes an elongated leaf spring having a concave side opening outwardly and two opposed ends, each said spring end being bifurcated to provide two spring fingers thereat, one for each of the two seals in the single groove.

16. The rotary machine of claim 9 wherein said wall is trochoidal in shape.

* * * * *

UNITED STATES PATENT AND TRADEMARK OFFICE

CERTIFICATE OF CORRECTION

PATENT NO. : 7,097,436 B2
APPLICATION NO. : 10/882693
DATED : August 29, 2006
INVENTOR(S) : David S. Wells It is certified that error appears in the above-identified patent and that said Letters Patent is hereby corrected as shown below:

Column 8, line 18, delete “each pair”.

Signed and Sealed this

Twenty-sixth Day of December, 2006

JON W. DUDAS
*Director of the United States Patent and Trademark Office*